US006286185B1

(12) United States Patent
Ramsauer

(10) Patent No.: US 6,286,185 B1
(45) Date of Patent: Sep. 11, 2001

(54) HINGE FOR METAL CUPBOARD DOORS

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/462,728

(22) PCT Filed: Mar. 17, 1998

(86) PCT No.: PCT/EP98/01539

§ 371 Date: Jan. 10, 2000

§ 102(e) Date: Jan. 10, 2000

(87) PCT Pub. No.: WO98/59138

PCT Pub. Date: Dec. 30, 1998

(51) Int. Cl.[7] ..... E05D 7/04
(52) U.S. Cl. ..... 16/236; 16/249; 16/254
(58) Field of Search ..... 16/236, 242, 243, 16/245, 246, 248, 249, 254, 271, 272

(56) References Cited

U.S. PATENT DOCUMENTS

| | | | | |
|---|---|---|---|---|
| 566,323 | * | 8/1896 | Kelleher et al. | 16/249 |
| 1,149,213 | * | 8/1915 | Neuberth | 16/271 |
| 1,185,233 | * | 5/1916 | Minnis | 16/249 |
| 2,027,888 | * | 1/1936 | Solomon | 16/249 |
| 2,885,722 | | 5/1959 | Halliday . | |
| 4,142,271 | * | 3/1979 | Busse | 16/248 X |
| 4,156,301 | * | 5/1979 | Schneider et al. | 16/249 |
| 4,185,357 | * | 1/1980 | Busse | 16/236 X |
| 4,290,167 | * | 9/1981 | Lautenschlager | 16/249 |
| 4,630,332 | * | 12/1986 | Bisbing | 16/273 |
| 4,878,255 | * | 11/1989 | Grimstad et al. | 16/249 X |
| 5,095,582 | * | 3/1992 | Ohlsson | 16/254 X |
| 5,259,091 | * | 11/1993 | Mordick | 16/254 X |
| 5,561,888 | * | 10/1996 | Lautenschlager | 16/383 |
| 5,799,370 | * | 9/1998 | Davidian et al. | 16/236 |
| 6,152,554 | * | 11/2000 | Parisi | 16/249 X |

FOREIGN PATENT DOCUMENTS

| | | | | |
|---|---|---|---|---|
| 490366 | * | 2/1953 | (CA) | 16/249 |
| 1 809 408 | | 9/1970 | (DE) . | |
| 32 04 667 | | 8/1983 | (DE) . | |
| 94 13 891 | | 12/1995 | (DE) . | |
| 295 14 712 U 1 | | 2/1997 | (DE) . | |
| 0 118 050 | | 9/1984 | (EP) . | |
| 0 140 114 | | 5/1985 | (EP) . | |
| 2225608 | * | 6/1990 | (GB) | 16/249 |

OTHER PUBLICATIONS

*English Abstract of DE 295 14 712 U 1.

* cited by examiner

*Primary Examiner*—Lynne H. Browne
*Assistant Examiner*—David E. Bochna
(74) *Attorney, Agent, or Firm*—Reed Smith LLP

(57) ABSTRACT

A hinge for metal cupboard doors or the like, comprising a first hinged piece such as a hinge plate with one or several counterbored holes for fixing screws and a second hinge piece articulated on the first hinge piece such as a hinge frame or hinge plate, which is also provided with several counterbored holes for fixing screws, wherein the holes of the at least one hinge part are configured as oblong holes. The hinge is provided with a fixing screw bushing which can be fitted into the oblong hole, and whose part fitting into the counterbored area of the oblong hole has a cross-section which differs from a circular form, i.e. a quadratic cross-section, preferably a longitudinally extended rectangular, rectangular with added semicircles of an oval cross-section, and whose longitudinal extension is (the same or) greater than the transversal extension of the counterbored area of the oblong hole and whose inner counter matches the shape of the fixing screw.

20 Claims, 5 Drawing Sheets

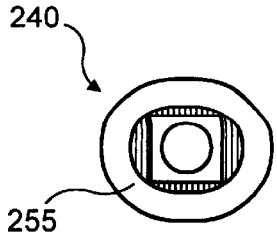
FIG. 13
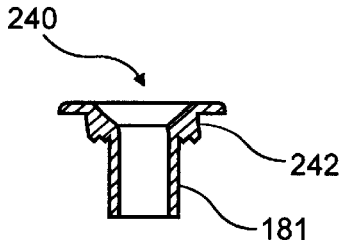
FIG. 14
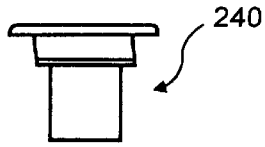
FIG. 15
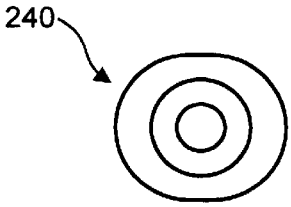
FIG. 16/17
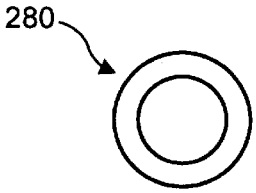
FIG. 18
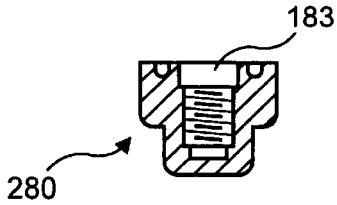
FIG. 19
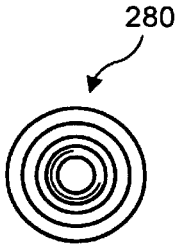
FIG. 20
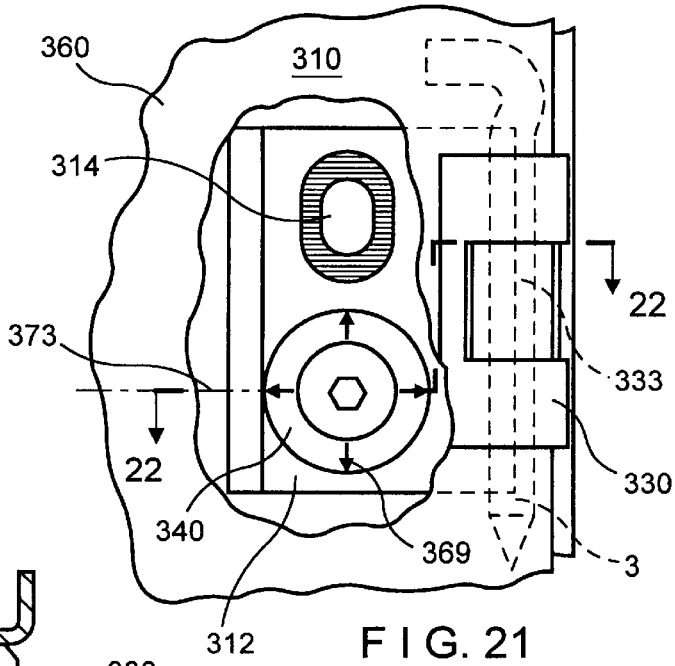
FIG. 21
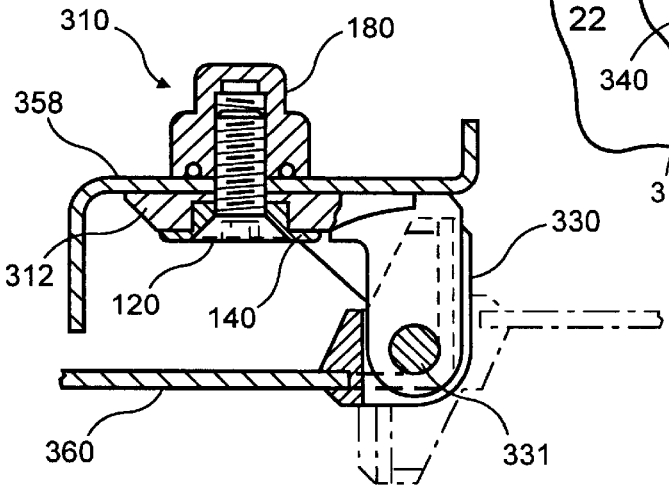
FIG. 22
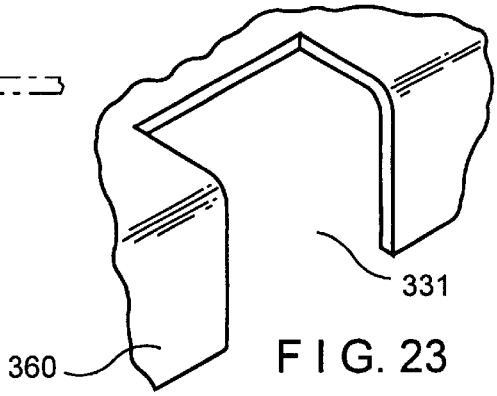
FIG. 23

HINGE FOR METAL CUPBOARD DOORS

BACKGROUND OF THE INVENTION a) Field of the Invention

The invention is directed to a hinge for sheet-metal cabinet doors, machine casings, housing covers, or the like, comprising a first hinge part, such as a hinge leaf, with one or more countersunk openings for fastening screws and with a second hinge part articulated at the first hinge part, such as a hinge support or another hinge leaf, provided with one or more openings for fastening screws, wherein the countersunk openings of the at least one hinge part are constructed as elongated holes.

b) Description of the Related Art

A hinge of the type mentioned above is already known from the German Utility Model 29 51 712.1 of the present Applicant. Compared with previous constructions, for example, those cited in this Utility Model as prior art, the screw-on hinge known from this Utility Model already overcomes certain disadvantages occurring particularly in sheet-metal cabinet doors; that is, sheet-metal cabinet doors tend to warp during production or when mounted, which can impede opening and closing of the door, especially when close fits are provided between the door frame and door leaf. In order to avoid this disadvantage, it is suggested in the Utility Model to construct the openings in the hinge leaves as elongated holes. A certain adjusting possibility will result depending on the orientation of these elongated holes. If the orientation is parallel to the hinge axis, the height of the door leaf can be adjusted with respect to the door frame, for example. On the other hand, if the orientation is vertical to the hinge axis, the vertical gap between the door leaf and door frame can be adjusted with respect to its width.

In the reference cited above, the hinge comprises two leaves, which offers the possibility of providing a leaf with elongated holes oriented parallel to the hinge axis and the other leaf with elongated holes oriented perpendicular thereto, so that a two-dimensional alignment possibility is provided.

The reference states that it is advantageous to countersink these openings and, instead of standard screw bolts and nuts for fastening the hinge leaves, to use screws which are screwed into rivet nuts or blind rivet nuts. Cap screws whose head dimensions are adapted to the dimensioning of the countersink on the outer side of the hinge leaf are provided as fastening screws. On the other side, the rivet nuts or blind rivet nuts form an outer rivet collar having an outer diameter to which a (necessary) countersink on the inner side of the hinge leaf is adapted. In this way, the projecting rivet collar can be received on the one hand and its interfering influence can accordingly be eliminated and, on the other hand, this rivet collar can be utilized for alignment and for additional support of the hinge plates.

However, it is disadvantageous that rivet nuts or blind rivet nuts of the type mentioned above which project over the sheet-metal surface and are fixedly connected with the sheet metal of the door leaf or door frame can only be used in certain cases. If the fastening means are to be completely removed for certain purposes or if the projections are bothersome, nuts which are riveted in in this way cannot be used.

A further disadvantage of the known arrangement consists in that the fastening screw can move in the elongated hole along the longitudinal extension thereof when the fastening screw is not properly tightened. This risk is particularly high when the sheet-metal cabinet is subjected to a shaking movement during transport or during operation. A further disadvantage consists in that the elongated hole also remains partly visible when the fastening screw is mounted and there remain openings acting as dirt collectors which can be troublesome, e.g., when a switching cabinet is used in the food industry.

A further disadvantage consists in that the known hinge must always be adjusted even when the cabinets are manufactured in a very precise manner. The reason for this is that the known hinge has no "zero setting" or "reference position" which could be used when an adjustment was really not required in terms of the basic design of the cabinet.

OBJECT AND SUMMARY OF THE INVENTION

It is the primary object of the invention to further develop a hinge of the type mentioned above in such a way that, without the aid of rivet nuts or blind rivet nuts which must be fixedly and non-removably introduced in the sheet-metal material, as many advantages of the latter as possible are achieved, especially increased strength relative to shear forces, improved security with respect to unwanted displacement, possible use of a zero position or reference position when required, and complete covering of the elongated hole opening when required.

This object is met according to the invention in that the hinge is provided with a fastening screw bushing which can be received so as to fit in the countersunk hole and which projects into the hinge leaf and possibly through this hinge leaf and whose portion which extends into the countersunk area of the elongated hole and/or over the support surface of the hinge leaf has a cross section having a shape other than circular, such as a square cross section, but preferably an elongated cross section such as a rectangular cross section, a rectangular cross section with added semicircular portions, or an oval cross section, whose longitudinal extension is greater than (or equal to) the transverse extension of the countersunk area of the elongated hole and whose inner contour is adapted to the shape of the fastening screw.

On the one hand, this step increases the shear resistance of the arrangement because the bushing forms an additional material surface which resists the shear force; further, the screw is guided more exactly through the bushing, which facilitates mounting, and furthermore the bushing results in a larger support surface on the countersunk surface of the hinge leaf and therefore results in greater force transmission capacity which benefits strength, so that hinge leaves of plastic can be used in certain cases without the material being pressed apart by internal pressure on the lateral faces of the hole; further, the securing of the bushing against rotation within the countersink or within the door leaf opening which can be achieved according to the invention facilitates protection against unwanted loosening of the screws and, finally, additional embodiment forms having further advantages can be carried out.

It is possible to cover a larger support surface of the elongated hole and therefore reduce area pressure, which benefits the stability of the arrangement, according to a further development of the invention, in that the countersunk area of the elongated hole has, in cross section, side walls which are parallel to the axis of the opening and base surfaces perpendicular to these side walls and the portion of the bushing extending into the countersunk area of the elongated hole has a disk-shaped body whose circumference forms two oppositely located parallel portions whose radial spacing is equal to or slightly less than the clearance between the longitudinal walls of the countersunk area. Further, this results in a particularly reliable protection against rotation.

Protection against unwanted displacement in the direction of the elongated hole can be increased in particular in that the base surface of the countersunk area of the opening of the hinge leaf and the disk surface of the bushing supported thereon are roughened, e.g., ribbed. It is particularly advantageous when this ribbing runs substantially at right angles to the longitudinal axis of the elongated hole or to the longitudinal axis of the elongated cross section of the disk of the bushing.

In particular, the bushing can form a flange whose outer contour is selected in such a way that it covers the countersunk opening in every possible position of the bushing with respect to the elongated hole. This results in the intended complete covering of the elongated hole opening and accordingly in a favorable visual effect and avoids hollow spaces which open outward and in which dirt can settle. The flange can even absorb pressing forces and accordingly reduce forces acting on the side walls of the elongated holes, which is advantageous in plastic hinge leaves.

A further construction of the invention according to which the bushing forms a projection or shoulder extending through the elongated hole opening is particularly advantageous. When this shoulder extends over the support surface of the hinge leaf only so far that it remains in the wall material of the sheet-metal cabinet door or the like, a standard nut can be used. According to a further development, a cap nut is provided, in which the free end of the shoulder can be received so as to be fixed with respect to rotation relative to it. In this case, the shoulder penetrates the wall thickness of the door leaf and can accordingly project into the cap nut in a countersink formed by the latter. This construction is particularly stable, prevents the fastening nut from rotating along when the fastening screw is actuated, and also enables improved sealing of the entire arrangement. This sealing is further improved in that the cap nut has, on its support surface, an annular groove for an O-ring seal.

According to another embodiment form of the invention, the outer surface of the flange of the bushing is provided with a mark, for example, an arrow, which indicates, for example, the center transverse axis of the elongated profile of the disk, and a further mark is arranged at the hinge leaf which indicates the center transverse axis of the elongated hole opening, so that a zero position or reference position is obtained for the arrangement which becomes useful when warping need not be taken into account because of the cabinet construction, so that mounting can be carried out first with the reference position. Should it turn out subsequently that this reference position does not result in a satisfactory alignment, an alignment can still be carried out subsequently.

The bushing is advantageously provided with a conical countersink for receiving the appropriate conical head of the fastening screw. In this way, it is possible, e.g., to use commercially-available cap screws, which reduces production costs for the arrangement. A further advantage of this conical countersink consists in that there is more substance or material available so that the other tasks of the bushing can be better carried out.

The fastening screws are advantageously provided with a polygon countersink for a screwing tool in order to facilitate assembly.

BRIEF DESCRIPTION OF THE DRAWINGS

The invention will be described more fully with reference to embodiment examples shown in the drawings.

FIG. 13 shows a view from below of a fastening screw bushing fitting the embodiment form according to FIGS. 11 and 12;

FIG. 14 shows an axial sectional view of the fastening screw bushing according to FIG. 13;

FIG. 15 shows a side view of this bushing;

FIG. 16 shows a top view of this bushing;

FIG. 18 shows a top view of a cap nut which is constructed so as to fit the bushing according to FIGS. 13 to 16;

FIG. 19 shows an axial sectional view through this cap nut;

FIG. 20 shows a view of this cap nut from the bottom;

FIG. 21 shows a top view in partial section of another embodiment form of the invention;

FIG. 22 shows a section through the arrangement according to FIG. 21 vertical to the hinge axis;

FIG. 23 shows an accompanying mortise of the door for mounting the hinge arrangement shown in FIGS. 21 and 22;

DESCRIPTION OF THE PREFERRED EMBODIMENTS

Figure 24:
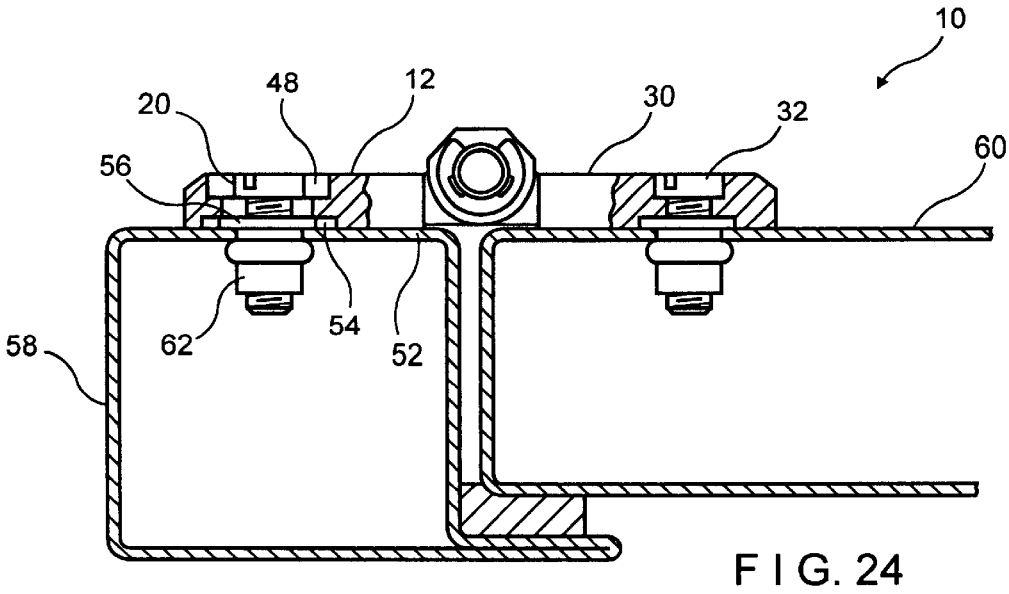
FIG. 24 shows a sectional view transverse to the hinge axis through a hinge arrangement for illustrating the advantages according to the invention.
Figure 25:
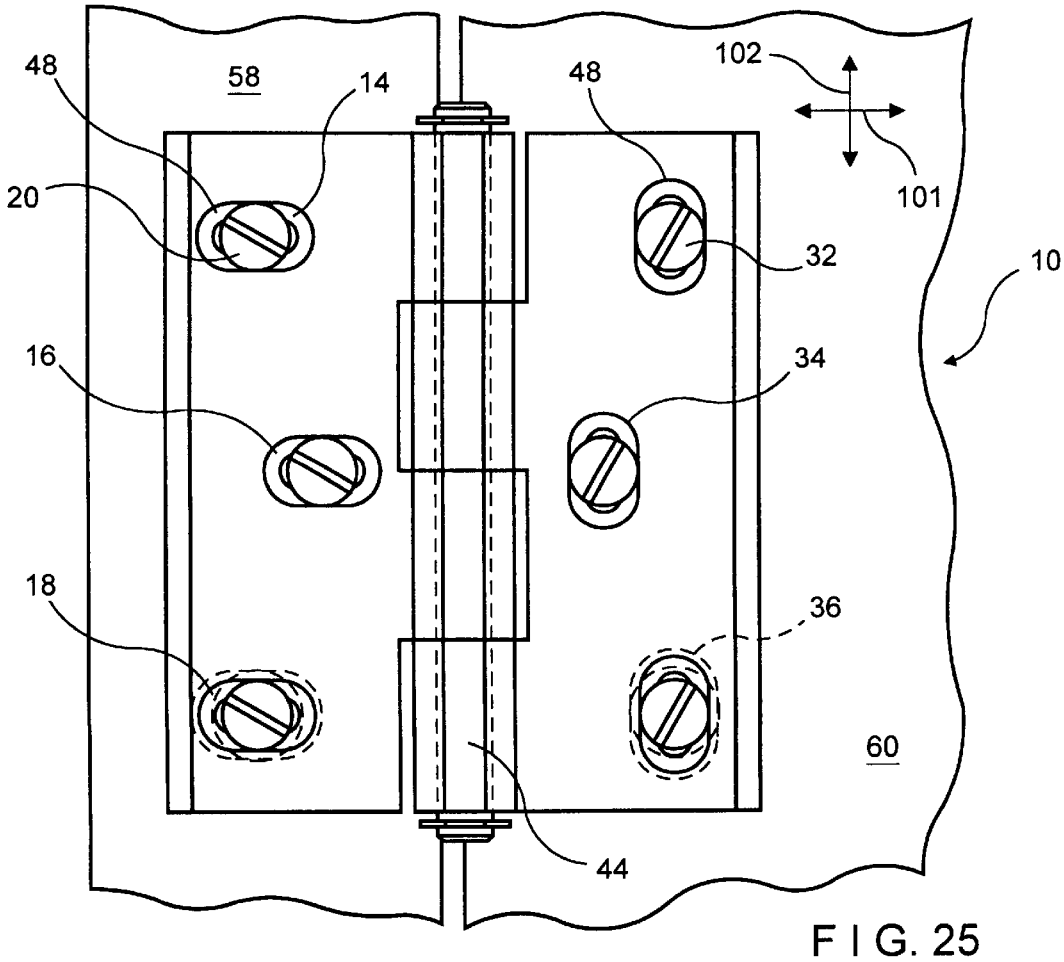
FIG. 25 shows a top view of the arrangement according to FIG. 24.

FIGS. 24 and 25 will be discussed first. These Figures show a sectional view and a top view of a screw-on hinge 10 for sheet-metal cabinet doors, or the like, which comprises a first hinge part 12, in this case, a hinge leaf, with at least one, in this case, with three, countersunk openings 14, 16, 18 for fastening screws 20, and a second hinge part 30 which is articulated at the first hinge part 12, in this case, also a hinge leaf 30 provided with a plurality of openings 32, 34, 36 for fastening screws, wherein the countersunk openings 14, 16, 18 of at least one hinge part are constructed as elongated holes. In the present case, the hinge leaf 12 is fastened to a door frame 58 and the hinge leaf 30 is fastened to a door leaf 60.

The elongated holes 14, 16, 18 of the hinge leaf 12 are oriented substantially at right angles to the axis of the hinge, 44, while the orientation of the elongated holes 32, 34, 36 of the other hinge leaf 30 extends parallel thereto as can be seen in FIG. 25. The arrangement of the direction of the elongated holes at right angles to the axis 44 makes it possible to adjust in the direction of the double-arrow 101 and therefore enables an alignment of the door leaf 60 with respect to the door frame 58 for adjusting the door gap formed therebetween as can be seen in FIG. 24. On the other hand, the orientation of the openings 32, 34, 36 perpendicular thereto in the other hinge leaf 30 makes it possible to align the door leaf 60 in the direction of the double-arrow 102 parallel to the hinge pin or axis 44 and accordingly allows the height of the door leaf to be adapted or adjusted with respect to the door frame or the like, that is, in a direction parallel to the hinge axis.

In the construction shown in FIG. 24, the screws which hold the hinge leaf 12 at the door frame 58 and the hinge leaf 30 at the door leaf 60 are screwed into threads formed by blind rivet nuts 62 which are introduced in the door frame 58 and door leaf 60. Blind rivet nuts 62 of this kind have a collar 56 which projects over the support surface 58 for the hinge leaf 12. This is disadvantageous in certain applications and further requires a corresponding countersink 54 in the support surface 52 of the hinge leaf 12 and 30.

The constructions described with reference to FIGS. 1 to 23 and 26, 27 make do with simple openings in the sheet metal (with a rectangular profile in FIGS. 26 and 27) at which the hinge devices are to be fastened or use threaded devices (FIG. 1) which do not project beyond the support surface of the sheet-metal cabinet on which the hinge leaf is to be mounted.

Figure 1:
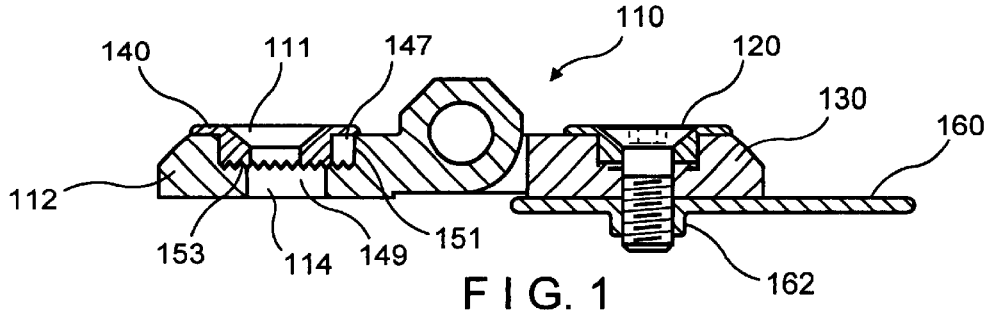
FIG. 1 shows a first embodiment form of a hinge constructed according to the invention in a sectional view vertical to the hinge axis.

Accordingly, FIG. 1 shows a hinge 110 for sheet-metal cabinet doors, or the like, comprising a first hinge part 112 with a plurality of countersunk openings, in this case, two, 114, 118 and a second hinge part 130 which is articulated at the first hinge part 112 and likewise has a plurality of openings, in this case, two, 132, 136 for receiving fastening screws 130, wherein the openings are countersunk elongated holes and the orientation of the elongated holes 114, 118 of one hinge part 112 extends at right angles to the hinge axis 44 similar to the view in FIG. 25, while the elongated holes 132, 136 of the other hinge part 130 are oriented perpendicular thereto, that is, parallel to the hinge axis 44.

In the construction according to FIGS. 24 and 25, the heads of the fastening screws 20, 32 are accommodated in countersinks 48. The heads of these fastening screws can guide the hinge during displacement in the direction of the elongated hole in case these heads reach to the walls of the countersinks.

Figure 5:
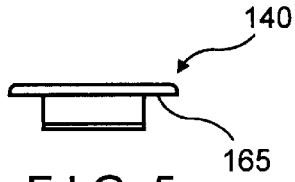
FIG. 5 shows a side view of this bushing.

In the construction according to FIG. 1, see also the top view according to FIG. 2, a fastening screw bushing 140 which can be received so as to fit in the elongated hole is provided in the countersunk elongated hole 114, 118 or 132, 136; the fastening screw bushing 140 is shown from below in FIG. 3, in an axial view in FIG. 4, in a side view in FIG. 5, and in a top view in FIG. 6. This bushing has a countersunk round bore hole 111 whose shape is adapted to the fastening screw 120 to be used, preferably in such a way that the end face of the screw head is flush with the outward facing end face of the bushing, see reference number 141, so that the two form a smooth surface. If the screw head is constructed cylindrically, as is shown in FIG. 24, the countersunk opening 111 of the bushing 140 will also be constructed in this manner and a cylindrical countersink will be provided. However, in the preferred countersunk cap screw according to FIG. 1 with its conically extending head, the countersunk bore hole 114 is also provided with a corresponding conically shaped countersink.

When screwing the screw 120 into a thread 162 which is formed, e.g., by a sheet-metal wall 160, it is advantageous to ensure that the bushing 140 is not carried along in the opening, e.g., 118, formed by the hinge leaf 112 or 130. For this reason, the portion of the bushing extending into the countersunk area of the elongated hole (e.g., 118, area 143) is provided with a cross section not having a circular shape, such as a square cross section, preferably an elongated cross section such as a rectangular cross section (FIG. 13), a rectangular cross section with added semicircular portions (FIG. 3), or an oval cross section, whose longitudinal extension 143 is greater than the transverse extension 145 of the countersunk area 147 of the associated elongated hole, e.g., elongated hole 118. In this way, it is ensured that the fastening screw bushing 140 is inserted with its longer extension in the longitudinal extension of the countersink of the associated opening and is also held in this direction. In the case of openings 114, 118, this is the direction perpendicular to the hinge axis 144 and in the case of openings 132, 136 this is the direction parallel to the axis 44.

It is most simple for the countersink 147 of the elongated hole, e.g., 114, according to FIG. 1, to have, in cross section, side walls 151 parallel to the opening axis 149 and base surfaces 153 at right angles thereto, and for the portion 142 of the bushing 140 extending into the countersunk area 147 of the elongated hole to form a disk-shaped body whose circumference 155 forms two oppositely located parallel portions 157, 159 whose distance 161 from one another is equal to or slightly less than the clearance 145 between the longitudinal walls of the countersink 147.

The base surface 153 of the countersink 147 of the opening, e.g., 118, of the hinge leaf, e.g., 112, and the disk surface 163 of the bushing 140 supported thereon are advantageously roughened, e.g., ribbed. This ribbing is advisably formed essentially perpendicular to the longitudinal axis of the elongated cross section of the disk of the bushing 140 or to the base surface of the countersink of the elongated hole 118.

This step reduces the risk of slippage in the direction of the extension of the elongated hole when the fastening screw is tightened. The distance between the individual ribs determines the increment and, therefore, the accuracy of adjustment, e.g., 1 . . . 1.5 mm.

Figure 2:
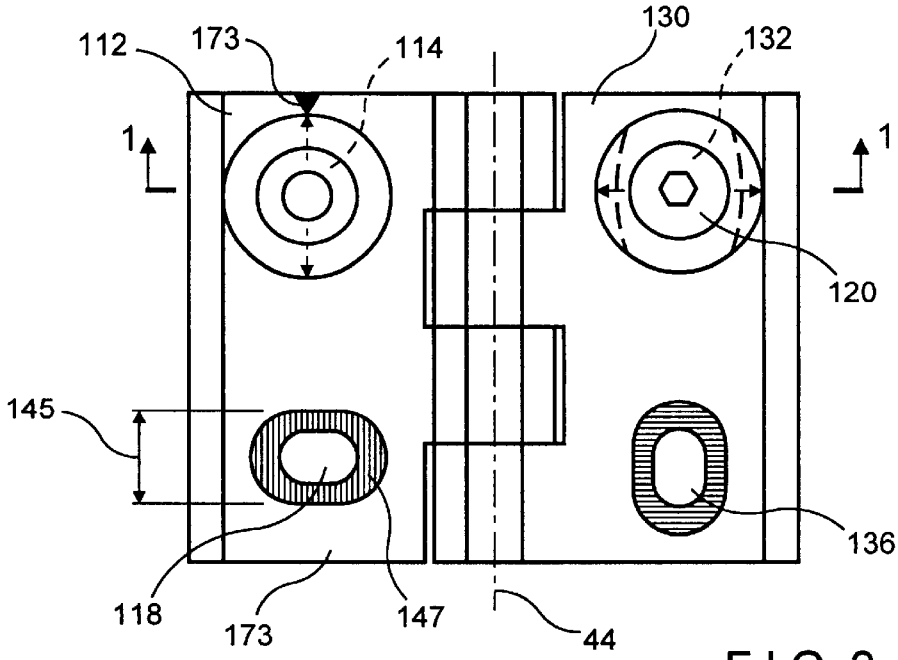
FIG. 2 shows a top view of the hinge according to FIG. 1.
Figure 3:
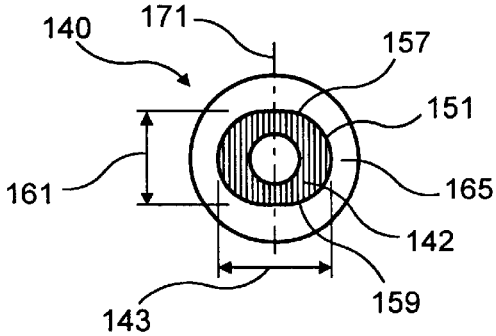
FIG. 3 shows a view from below of a fastening screw bushing constructed according to the invention.
Figure 4:
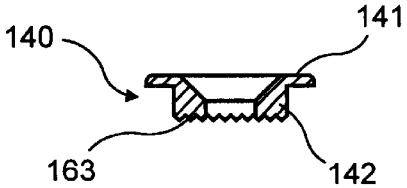
FIG. 4 shows an axial sectional view of this bushing.

As can be seen in FIG. 2 in combination with FIGS. 3 to 6, the bushing 140 forms a flange 165 whose outer contour 167 is selected in such a way that it covers the countersunk opening 147 in every position of the bushing 140 with respect to the elongated hole (e.g., 118).

The hollow spaces, see 147 in FIG. 1, formed by the elongated hole are therefore closed toward the outside and, therefore, dirt can no longer collect there.

The appearance is also improved in this way as a comparison of FIG. 25 and FIG. 2 makes clear.

Figure 6:
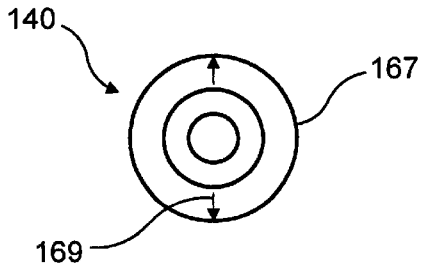
FIG. 6 shows a top view of this bushing.

As is shown in FIG. 6, the flange can have a mark, e.g., in the form of an arrowhead 169.

This arrow 169 indicates, e.g., the center transverse axis 171 of the elongated profile of the disk 142 which can be referenced with a mark 173 carried by the associated hinge part, e.g., 112, in FIG. 2. In this way, it is possible when inserting the bushing 140 into the bore hole 118 to bring the bushing 140 first into a determined reference position (zero position), preferably the center position with respect to the two alignment movements within the elongated hole, so that it is possible to preassemble the hinge in a determined position. If it turns out later that this "normal" position is not optimal because of manufacturing tolerances, the fastening screw 120 can be loosened and displaced together with the bushing 140 along the extension of the elongated hole until the desired adjustment is achieved, whereupon the screw is tightened again and the bushing is secured inside the opening 118 due to the pressing pressure exerted by the fastening screw, which is possibly strengthened by the roughening or ribbing of the base surface 153 and 163.

Figure 7:
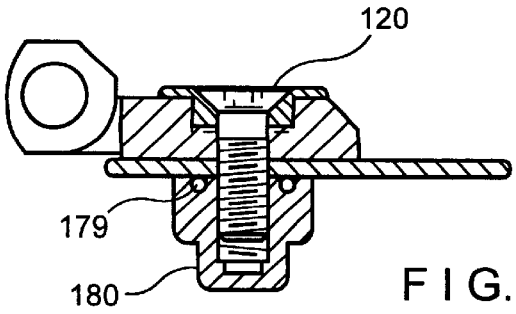
FIG. 7 shows a view similar to FIG. 1 of another embodiment form of the hinge in which a cap nut is used.
Figure 8:
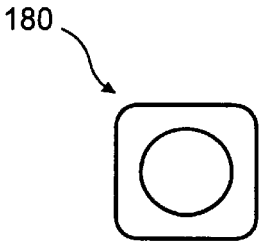
FIG. 8 shows a top view of the cap nut.
Figure 9:
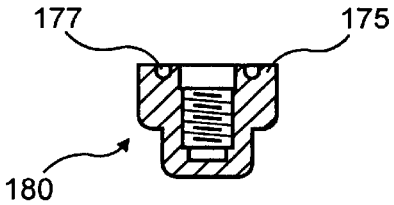
FIG. 9 shows an axial sectional view through the cap nut.
Figure 10:
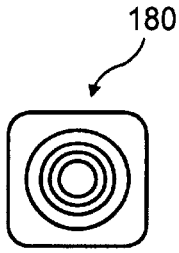
FIG. 10 shows a rear view of the cap nut.
Figure 26:
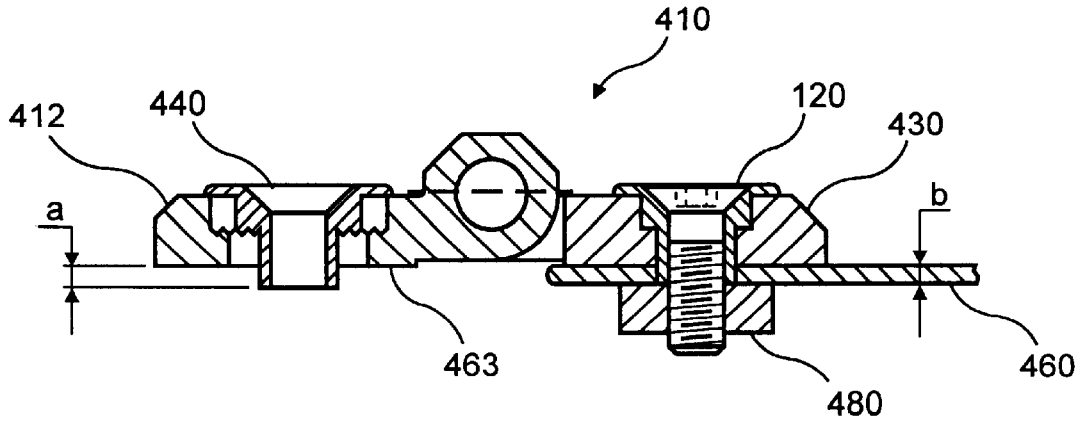
FIG. 26 shows a sectional view similar to FIG. 11 of another embodiment form in which the bushing extends up to the door leaf material, but does not penetrate it.

Instead of providing, e.g., a bead in the sheet metal 160, in which a thread can be cut, see reference number 162 in FIG. 1, a standard screw nut 480, possibly with a washer, can also be provided, see FIG. 26. In an alternative and especially favorable embodiment form, a cap nut 180 is provided instead of a standard nut as can be seen in FIG. 7. The cap nut 180 is shown in a top view in FIG. 8, in a cross-sectional view in FIG. 9, and in a separate view from the bottom in FIG. 10. The special advantage of this cap nut 180 consists above all in the possibility of ensuring a gastight closure because the rear end of the screw 120 is completely enclosed, wherein the cap nut 180 can also have, on its support surface 175, an annular groove 177 in which an O-ring seal 179 can be inserted.

Figure 11:
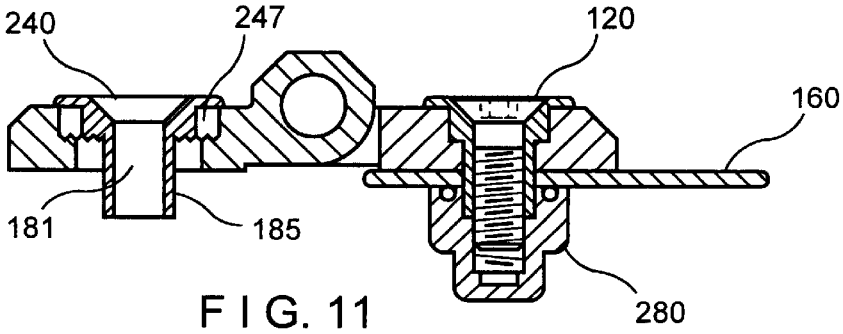
FIG. 11 shows a sectional view similar to FIG. 1 of another embodiment form of a hinge constructed according to the invention.

In views similar to FIGS. 1 and 2, FIGS. 11 and 12 show another embodiment form of the hinge according to the invention in which the bushing 240 forms a shoulder 181 extending through the elongated hole opening 218, 236 and also through the material of the door leaf 160 (e.g., through a round hole 161) and is used in combination with a cap nut 280 which has an offset or countersink 183 in which the free end 185 of the shoulder 181 can be received so as to fit therein and, in particular, so as to be fixed with respect to rotation relative thereto, as can be seen in FIG. 11. It is most simple to provide the shoulder 181 with a rectangular shape in cross section as is shown in FIG. 13, where the countersink 183 has a corresponding rectangular cross section. These steps make it possible to hold the nut 280 by means of the bushing 240 so as to rigid against rotation, so that it is not carried along when screwing in the fastening screw 120 and it is no longer necessary to hold this cap nut 280, e.g., with a tool, when tightening the screw 120.

Figure 12:
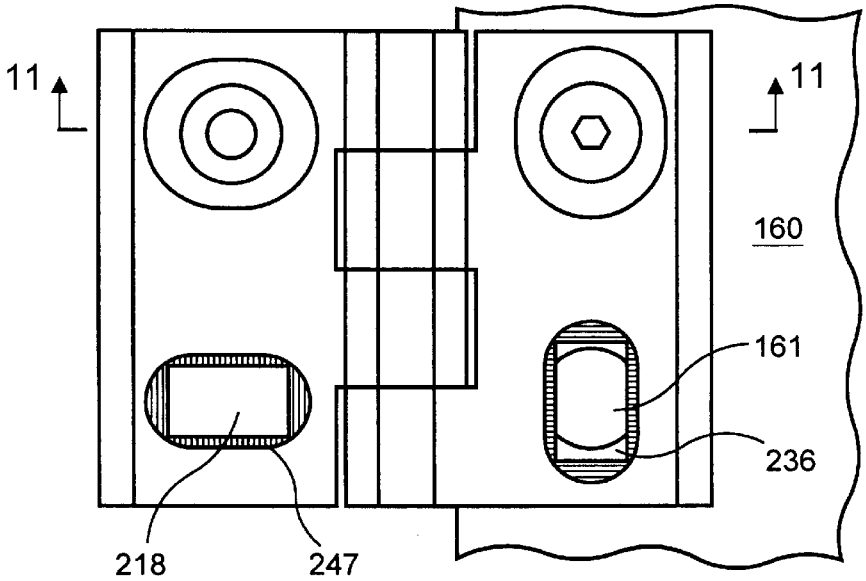
FIG. 12 shows a top view of the hinge according to FIG. 11.

In order to receive this shoulder 181, the opening 218 in FIG. 12 is constructed somewhat differently than the opening 118 in FIG. 2. In particular, the opening 218 is, in this case, rectangular and somewhat larger, while the countersunk region 247 forms a rectangle with added semicircular portions similar to the embodiment form shown in FIG. 2. The rest of the steps described above such as an O-ring seal for the cap nut, roughened or ribbed support surfaces, marks for the orientation of the bushing, etc., can also be used in this case.

While the preceding description of embodiment examples referred to hinges formed of two screw-on parts, in the embodiment form shown in FIG. 21 only one hinge part, namely, hinge part 312 in this case, is screwed to a cabinet frame 358, specifically, by using the bushings 140, fastening screws 120 and cap nuts 180 that have already been described. In order to protect against rotation, at least two such screws are advantageously provided, as is clearly shown in FIG. 21. The other hinge part 330, on the other hand, is fastened in a mortise or notch 331 in the door leaf 360 by means of a clamping pin 333 which, in the present case, also simultaneously forms the hinge pin. This type of fastening is known, per se, and is mentioned only to show that the arrangement according to the invention can be used in different types of hinges.

In the embodiment form shown in FIGS. 21 and 22, the orientation of the countersunk elongated hole openings is parallel to the hinge axis, so that the height adjustment of the door leaf 360 can be changed with respect to the door frame 350.

In a construction with perpendicular orientation of the elongated holes relative to the hinge axis, it would be possible to adjust the lateral distance of the door leaf from the door frame.

In this case, also, further developments such as those already mentioned in connection with the preceding embodiment examples are also possible.

The most advantageous shape for the head of the fastening screw 120 is the truncated cone shape shown in the drawing because this shape provides more material for the cross section of the bushing according to the invention than would be possible in other head shapes. More material increases the strength of the bushing and provides more leeway for other configurations.

As can be seen, for example, from FIG. 21, the head of the fastening screw 120 advantageously has a hexagon countersink for receiving a corresponding tool. Alternatively, a cross-recessed countersink, as is generally known, could also be provided, for example.

The hinge according to the invention with its different embodiment forms dispenses with the special rivet nuts in the cabinet sheet metal such as those described in connection with FIGS. 23 and 24, for example; however, it also dispenses with elongated holes in the sheet metal, which are not only difficult to produce but also difficult to seal, and yet are required for standard hinges when adjustability is necessary.

Figure 27:
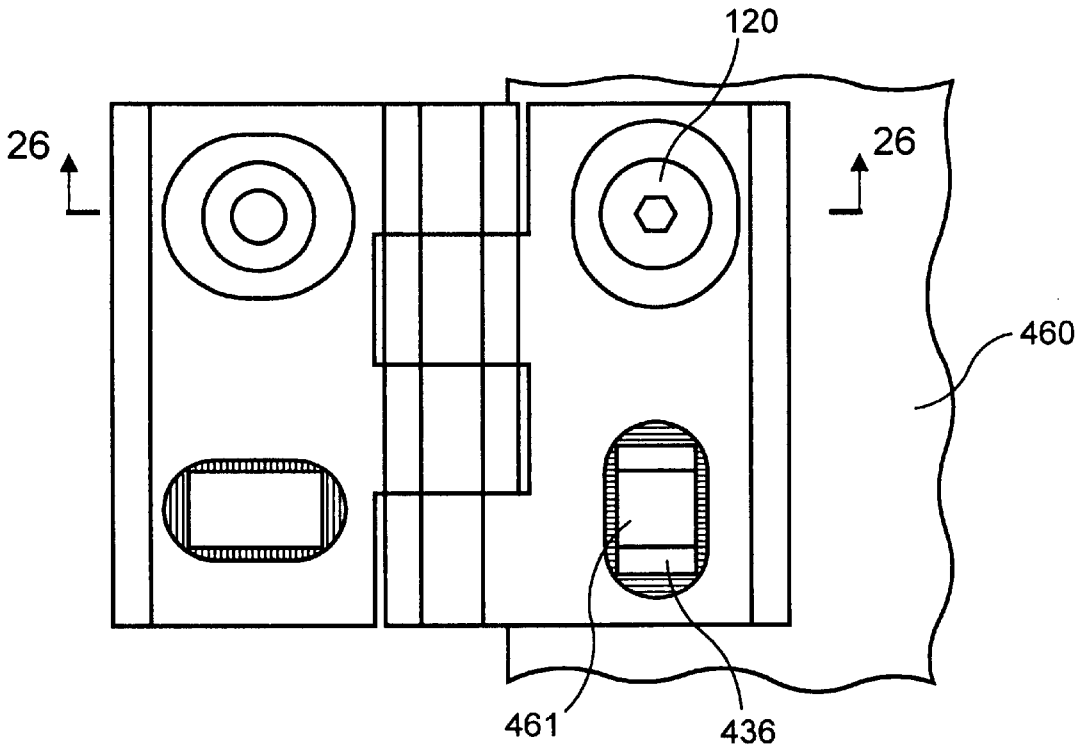
FIG. 27 shows a top view of the hinge according to FIG. 26 showing a door opening with a square cross section for receiving the shoulder of the bushing such that this shoulder is fixed with respect to rotation relative to it.

On the other hand, square holes which are conventional in sheet-metal cabinet construction, for example, with dimensions of 4×4 mm or 8×8 mm, see, e.g., FIG. 27, opening 461, are well-suited for the arrangement according to the invention. In this case, the circumferential contour 255, see FIG. 13, of the portion 242 of the bushing extending into the countersunk area 247 can be round because the protection against rotation is now ensured by the square hole in the sheet-metal cabinet. Further, it is possible to use the bushings in four positions that are offset by 90°, wherein four corresponding marks can be provided as is indicated in FIG. 21 by arrows 369.

When the fastening screw bushings 440 are, e.g., square in cross section, extend into the sheet metal 460, are secured therein against relative rotation and do not exceed the material thickness b of the door leaf 460 with their end projecting out over the support surface 463 by distance a, a standard nut 480, possibly with a washer (not shown), can be used instead of a special nut 280 with a countersink 183 which would have to receive the end 185 of the bushing extending through the sheet metal 160 as was described in FIG. 11.

The invention can be commercially applied in switch cabinet construction.

While the foregoing description and drawings represent the present invention, it will be obvious to those skilled in the art that various changes may be made therein without departing from the true spirit and scope of the present invention.

What is claimed is:

1. A hinge for sheet-metal cabinet doors, machine casings, housing covers, or the like, comprising:

a first hinge part, such as a hinge leaf with one or more countersunk openings for fastening screws;

a second hinge part articulated at the first hinge part, including one of a hinge support or another hinge leaf provided with one or more openings for fastening screws;

wherein the countersunk openings of the at least one hinge part being constructed as elongated holes;

a fastening screw bushing which can be received so as to fit in the countersunk elongated hole and having a portion which projects into the hinge leaf;

said portion which extends into the countersunk area of the elongated hole having an outer cross section having a shape which differs from a circular shape, and is selected from a group consisting of a square outer cross section, an elongated outer cross section such as a rectangular outer cross section, a rectangular outer cross section with added semicircular portions, and an oval outer cross section;

said bushing having a longitudinal extension at least equal to the transverse extension of the countersunk area of the elongated hole;

said fastening screw bushing having a contour which is adapted to the shape of the fastening screw;

said countersunk area of the elongated hole having, in cross section, side walls which are parallel to the axis of the opening and base surfaces which are perpendicular to these side walls;

said portion of the bushing extending into the countersunk area of the elongated hole comprising a disk-shaped body whose circumference forms two oppositely located parallel portions whose radial distance from one another is equal to or slightly less than the clearance between the longitudinal walls of the countersunk area;

the countersunk area of the opening of the hinge leaf having a base surface and the disk surface of the bushing supported thereon which surfaces are roughened and form a ribbing;

said bushing forming a flange whose outer contour is selected in such a way that it covers the countersunk opening in every possible position of the bushing with respect to the elongated hole;

and wherein said bushing forms a shoulder extending through the elongated hole opening.

2. The hinge according to claim 1, wherein the ribbing runs substantially at right angles to the longitudinal axis of the elongated hole or to the longitudinal axis of the elongated cross section of the disk of the bushing.

3. The hinge according to claim 1, wherein the bushing projects beyond the support surface of the hinge by a distance which is less than or, at most, equal to the thickness of the material of the sheet-metal cabinet door or the like.

4. The hinge according to claim 1, wherein the outer cross section of the portion of the bushing projecting beyond the support surface of the hinge is held so as to be rigid against rotation in a non-round opening in the door leaf or the like.

5. The hinge according to claim 1, wherein a cap nut is provided.

6. The hinge according to claim 5, wherein the cap nut forms a countersink in which the free end of a shoulder can be received so as to be rigid against rotation.

7. The hinge according to claim 5, wherein the cap nut forms, on its support surface, an annular groove for receiving an O-ring seal.

8. The hinge according to claim 1, wherein the outer surface of the flange of the bushing has a mark such as an arrow which indicates the center transverse axis of the elongated profile of the disk and wherein the hinge part has a mark which indicates the center transverse axis of the elongated hole opening.

9. The hinge according to claim 1, wherein the bushing has a conical countersink for receiving the appropriate conical head of the fastening screw.

10. The hinge according to claim 1, wherein the fastening screw has a polygonal countersink for a screwing tool.

11. The hinge according to claim 1, wherein the hinge leaves are made of plastic.

12. The hinge according to claim 11, wherein the bushings are also made of plastic.

13. A hinge for sheet-metal cabinet doors, machine casings, housing covers, or the like, comprising:

a first hinge part, such as a hinge leaf with one or more countersunk openings for fastening screws;

a second hinge part articulated at the first hinge part, including one of a hinge support or another hinge leaf provided with one or more openings for fastening screws;

wherein the countersunk openings of the at least one hinge part being constructed as elongated holes;

a fastening screw bushing which can be received so as to fit in the countersunk elongated hole and having a portion which projects into the hinge leaf;

said portion which extends into the countersunk area of the elongated hole having an outer cross section having a shape which differs from a circular shape, and is selected from a group consisting of a square outer cross section, an elongated outer cross section such as a rectangular outer cross section, a rectangular outer cross section with added semicircular portions, and an oval outer cross section;

said bushing having a longitudinal extension at least equal to the transverse extension of the countersunk area of the elongated hole;

said fastening screw bushing having a contour which is adapted to the shape of the fastening screw;

said countersunk area of the elongated hole having, in cross section, side walls which are parallel to the axis of the opening and base surfaces which are perpendicular to these side walls;

said portion of the bushing extending into the countersunk area of the elongated hole comprising a disk-shaped body whose circumference forms two oppositely located parallel portions whose radial distance from one another is equal to or slightly less than the clearance between the longitudinal walls of the countersunk area;

the countersunk area of the opening of the hinge leaf having a base surface and the disk surface of the bushing supported thereon which surfaces are roughened and form a ribbing;

said bushing forming a flange whose outer contour is selected in such a way that it covers the countersunk opening in every possible position of the bushing with respect to the elongated hole; and wherein the outer surface of the flange of the bushing has a mark such as an arrow which indicates the center transverse axis of the elongated profile of the disk and wherein the hinge part has a mark which indicates the center transverse axis of the elongated hole opening.

14. The hinge according to claim 13, wherein the ribbing runs substantially at right angles to the longitudinal axis of the elongated hole or to the longitudinal axis of the elongated cross section of the disk of the bushing.

15. The hinge according to claim 13, wherein a cap nut is provided.

16. The hinge according to claim 15, wherein the cap nut forms a countersink in which the free end of a shoulder can be received so as to be rigid against rotation.

17. The hinge according to claim 15, wherein the bushing has a conical countersink for receiving the appropriate conical head of the fastening screw.

18. The hinge according to claim 13, wherein the fastening screw has a polygonal countersink for a screwing tool.

19. A hinge for sheet-metal cabinet doors, machine casings, housing covers, or the like, comprising:

a first hinge part, such as a hinge leaf with one or more countersunk openings for fastening screws;

a second hinge part articulated at the first hinge part, including one of a hinge support or another hinge leaf provided with one or more openings for fastening screws;

wherein the countersunk openings of the at least one hinge part being constructed as elongated holes;

a fastening screw bushing which can be received so as to fit in the countersunk elongated hole and having a portion which projects into the hinge leaf;

said portion which extends into the countersunk area of the elongated hole having an outer cross section having a shape which differs from a circular shape, and is selected from a group consisting of a square outer cross section, an elongated outer cross section such as a rectangular outer cross section, a rectangular outer cross section with added semicircular portions, and an oval outer cross section;

said bushing having a longitudinal extension at least equal to the transverse extension of the countersunk area of the elongated hole;

said fastening screw bushing having a contour which is adapted to the shape of the fastening screw;

said countersunk area of the elongated hole having, in cross section, side walls which are parallel to the axis of the opening and base surfaces which are perpendicular to these side walls;

said portion of the bushing extending into the countersunk area of the elongated hole comprising a disk-shaped body whose circumference forms two oppositely located parallel portions whose radial distance from one another is equal to or slightly less than the clearance between the longitudinal walls of the countersunk area;

the countersunk area of the opening of the hinge leaf having a base surface and the disk surface of the bushing supported thereon which surfaces are roughened and form a ribbing; and said bushing forming a flange whose outer contour is selected in such a way that it covers the countersunk opening in every possible position of the bushing with respect to the elongated hole;

wherein a cap nut is provided; and wherein the cap nut forms a countersink in which the free end of the shoulder can be received so as to be rigid against rotation.

20. The hinge according to claim 19, wherein the cap nut forms, on its support surface, an annular groove for receiving an O-ring seal.

* * * * *